United States Patent [19]

Abbott

[11] 3,980,532

[45] Sept. 14, 1976

[54] DEPOSITION OF BRASS BY ELECTROPLATING

[75] Inventor: Charles N. Abbott, Dayton, Ohio

[73] Assignee: Abbco, Inc., Dayton, Ohio

[22] Filed: Mar. 28, 1975

[21] Appl. No.: 562,836

[52] U.S. Cl. ..... 204/44

[51] Int. Cl.[2] ..... C25D 3/58; C25D 3/24

[58] Field of Search ..... 204/44

[56] References Cited

UNITED STATES PATENTS

| | | | |
|---|---|---|---|
| 1,573,233 | 2/1926 | Eldredge | 423/106 |
| 3,620,937 | 11/1971 | Lisowski et al. | 204/44 |

FOREIGN PATENTS OR APPLICATIONS

| | | | |
|---|---|---|---|
| 22,002 | 1906 | United Kingdom | 204/44 |
| 1,005,162 | 9/1965 | United Kingdom | 204/106 |

*Primary Examiner*—F.C. Edmundson

*Attorney, Agent, or Firm*—Francis M. Crawford

[57] ABSTRACT

The present invention relates to the electrodeposition of brass in a form suitable for use as undercoats for subsequently applied metal coatings, and to electrolytes suitable therefor, comprising a conventional cyanide brass elctrolyte containing a soluble manganous compound and a soluble nickel compound and preferably a chelating or sequestering agent.

3 Claims, No Drawings

DEPOSITION OF BRASS BY ELECTROPLATING

The present invention relates to electrolytes for the electrodeposition of brass comprising manganese in the form of a soluble manganous compound and nickel in the form of a soluble nickel compound. More particularly, it relates to conventional cyanide brass electrolytes containing manganese in the form of a soluble manganous compound, nickel in the form of a soluble nickel compound and a chelating or sequestering agent.

Electrodeposited brass has numerous applications in commerce and the desired properties of the deposited brass will vary somewhat depending upon the particular use of the electrodeposited brass. Such deposited brass has been found to be particularly suitable for use as an undercoat for other electrodeposited metals. When used for such purpose, however, it is particularly essential that the electrodeposited brass not only adhere well to the base on which it is deposited but also that it show on its surface no defects which will show through the coating of metal deposited thereon. It is also essential that the electrolyte remain in suitable form during the electroplating operation. The brass electrolytes of the prior art have been deficient in one or more of the requirements for satisfactory commercial preparation of electrodeposited brass coatings suitable for use as undercoats for other electrodeposited metals.

Although brass may be electrodeposited from electrolytes containing other soluble salts of copper and zinc all commercial electrolytes are generally cyanide solutions of copper and zinc together with sodium cyanide to furnish additional cyanide ions during the operation. The electrolyte also contains sodium hydroxide to regulate the pH of the solution. The ratio of copper cyanide to zinc cyanide may vary widely but, in general, the electrolyte should contain 70 to 30%, by weight, of copper metal and 30 to 70%, by weight, of zinc metal, the total concentration of metal in the electrolyte being 10 – 60 g/l with an optimum range of 30 – 45 g/l. The optimum ratio of copper to zinc is generally of the order of 55 – 60%, by weight, of copper metal to 45 – 40%, by weight, of zinc metal. In each instance the electrolyte also contains the conventional amounts of soluble alkali metal or alkaline earth metal hydroxide, usually added in increments of 0.15 g/1, the alkali metal or alkaline earth metal cyanide being present in excess of the amount required to form the water-soluble complexes $Na_2Cu(CN)_3$ and $Na_2Zn(CN)_4$.

The anode used in the electrolysis should preferably be approximately of the same copper: zinc ratio as in the electrodeposited brass.

The electrodeposition of the brass should preferably be effected within the range of 20 – 40 amperes/ft$^2$ current density, although the effective amperage as determined on a Hull Cell panel has been found to be within the range of 0.3 – 100 amperes/ft$^2$, or even higher.

The electrodeposition is effected within the range of 60° – 90°F, and preferably within the range of 70° – 75°F.

The time of the electrolysis will, of course, depend upon the thickness of the brass coating desired. In general, the operation will run for a period of 10 – 30 minutes.

In carrying out the electrolysis as above described with the basic copper cyanide-zinc cyanide-sodium cyanide-sodium hydroxide electrolyte coarse grains of brass will be formed which will generally show through subsequently applied coatings of other metals, thus making the basic electrolyte unsuited for use where the brass coating is to be used as an undercoating for other metals. Various methods have been tried in the past for obviating such difficulties without at the same time introducing other undesirable factors. It has been shown, for example, that the graininess incurred during the electrodeposition of brass can be eliminated by the introduction into the basic electrolyte of small amounts of a soluble manganous compounds, such as manganous sulfate, manganous carbonate, manganous gluconate, and the like. Other manganous salts sufficiently soluble in the basic electrolyte to give the required quantity of manganous ions can likewise be satisfactorily used.

The addition of such water-soluble manganous salts to the basic electrolyte has been found to eliminate completely the formation of the undesired graininess generally formed by the basic electrolyte. The use of such manganous compounds in the basic electrolyte, however, may cause the formation of precipitates in the electrolyte during the electroplating operation. It has been found, however, that this precipitation can be satisfactorily eliminated by incorporation in the basic electrolyte of a chelating or sequestering agent along with the soluble manganous compound.

While otherwise quite satisfactory for general use, including use as a suitable base for subsequent metal coating, the brass electroplated from brass electrolytes containing a soluble manganous compound and a chelating or sequestering agent, the brass thus deposited often shows an undesirable whitish cast or band which makes the thus electrodeposited brass less suitable for certain purposes. The present invention provides a method whereby such whitish cast or band can be satisfactorily and economically eliminated without otherwise affecting the properties of the electrodeposited brass. This is accomplished by incorporating small amounts of a soluble nickel compound into the basic brass electrolyte containing a soluble manganous compound and a chelating or sequestering agent. The brass electrodeposited from such an electrolyte under a wide range of electroplating conditions has been found to be free of undesired grain structure, as well as undesired whitish cast or whitish bands, and generally satisfactory for numerous uses, and particularly for subsequent coating with other metals, with the added advantage that during the electroplating no substantial formation of precipitate of sludge taken place.

In carrying out the improved electroplating process of the present invention the electrolyte used should contain a metal content of 10 – 60 g/l consisting of 70 – 30%, by weight, of copper metal, 30 – 70%, by weight, of zinc metal in the form of the corresponding cyanide salts. To this mixture is added sufficient sodium cyanide in an amount in excess of the amount required to form the water-soluble complexes $Na_2Cu(CN)_3$ and $Na_2Zn(CN)_4$. Sufficient sodium hydroxide is then added to regulate the pH of the bath preferably within the range of 9 – 13. Such an electrolyte is referred to herein as the "basic" electrolyte.

To the above basic electrolyte is then added 0.00005 g/1 – 0.1 g/l, and preferably, 0.0002 – 0.02 g/l of manganese in the form of a soluble manganous compound, such as, for example, manganous sulfate, manganous carbonate or manganous gluconate; 0.0001 – 0.1 g/l of nickel in the form of a soluble nickel compound, such as, for example, nickel formate, nickel carbonate or nickel sulfate; and 0.001 – 10.0 g/l, and preferably, 0.05 – 1.0 g/l of a chelating or sequestering agent, such as, for example, sodium gluconate, tartaric acid, sorbitol, ethylenediaminetetra acetic acid, or citric acid.

The following specific examples are given to illustrate the use of the above improved brass electrolyte. It is understood, however, that the disclosed invention is not to be limited to these specific examples since the plating bath, as well as the electroplating procedure, may be varied in any conventional manner without departing from the scope of the claimed invention, so long as the conditions hereinabove set forth are substantially followed.

EXAMPLE I

In this series of experiments the following "basic" electrolyte was used:

| | |
|---|---|
| Sodium cyanide | 5.05 oz/gal |
| Sodium hydroxide | 4.29 oz/gal |
| Copper (as cyanide) | 2.12 oz/gal |
| Zinc (as cyanide) | 1.45 oz/gal |
| Total metal | 3.57 oz/gal |
| % Copper metal | 59.4 |

Panels electroplated in the above "basic" electrolyte at a current density of 0.3 – 100 amperes/ft$^2$, for 15 minutes, to a final temperature of 73°F showed typical heavy graining in the LCD area and a white band in the medium LCD area.

Panels were next electroplated under similar conditions in the above basic electrolyte to which had been added 0.0015 g/l of manganese in the form of manganous sulfate. In these panels the heavy graining band shown in the preceding series of panels was completely eliminated but the white band was still shown in the medium LCD area.

Panels were next electroplated under similar conditions in the above basic electrolyte to which had been added 0.005 g/l of nickel in the form of nickel formate. The panels from this series showed complete elimination of the white band present in the preceding two series, with some but not complete reduction in the grain shown in the first series. Increasing the amount of nickel to 0.007 g/l gave some additional but not complete reduction in the grain. However, severe skipping occured at the low current edge of the panels, a result which would make the use of additional nickel highly objectional in commercial operation.

In the next series the operating conditions were identical with those of the preceding series but to the basic electrolyte had been added 0.0015 g/l of manganese in the form of manganous sulfate and 0.15 g/l of sorbitol (chelating agent). The resulting panels showed complete elimination of grain formed when no manganese in the form of manganous sulfate was present and no formation of precipitate or sludge but the white band in the medium LCD area reported in the first series of panels was not appreciably affected.

In this series, the same operating conditions were used and to the basic electrolyte was added 0.0015 g/l of manganese in the form of manganous sulfate, 0.005 g/l of nickel in the form of nickel formate, and 0.15 g/l of sorbitol. The resulting plates showed complete elimination of the grainy structue and the white band without skipping in the extreme LCD area and without the formation of precipitate or sludge in the electroplating bath.

EXAMPLE II

In this series of experiments the following basic electrolyte was used:

| | |
|---|---|
| Sodium cyanide | 4.45 oz/gal |
| Sodium hydroxide | 3.93 oz/gal |
| Copper (as cyanide) | 2.13 oz/gal |
| Zinc (as cyanide) | 1.54 oz/gal |
| Total metal | 3.67 oz/gal |
| % Copper metal | 58% |

Panels electroplated in the above basic electrolyte under the conditions described in Example I showed distinct grainy structure in the LCD area and a mild white band.

Panels electroplated under similar conditions in the basic electrolyte to which had been added 0.0005 g/l of manganese in the form of manganous sulfate showed no grain but did not appreciably reduce the white band present in the preceding series.

In the next series, carried out as previously described 0.001 g/l of nickel in the form of nickel formate was included in the basic electrolyte. The resulting panels showed some reduction in the formation of grain but not sufficient for commercial use. However, the white band was almost completely eliminated. Had the amount of nickel been doubled the white band would apparently have been completely eliminated.

Panels were next electroplated under conditions identical with those of the preceding series in the basic electrolyte to which had been added 0.001 g/l of nickel in the form of nickel formate, and 0.0005 g/l of manganese in the form of manganous carbonate. The resulting panels showed no grain and no white band and there was no skipping in the extreme LCD area.

EXAMPLE III

The basic electrolyte used in this experiment had the following composition:

| | |
|---|---|
| Sodium cyanide | 4.30 oz/gal |
| Sodium hydroxide | 4.02 oz/gal |
| Copper (as cyanide) | 1.79 oz/gal |
| Zinc (as cyanide) | 1.35 oz/gal |
| Total metal | 3.14 oz/gal |
| % Copper metal | 57.0 |

Panels electroplated in the above basic electrolyte under the conditions previously described showed a heavy grainy band in the LCD area and a white band in the medium LCD area.

Panels electroplated under similar operating conditions with the above basic electrolyte to which had been added 0.001 g/l of manganese in the form of manganous sulfate and 0.005 g/l of nickel in the form of nickel carbonate showed complete elimination of the white band and very slight grain formation.

The results of the above experiments clearly show the advantages in the use of the claimed combination in that it eliminates the undesirable factors resulting from the electrodeposition of brass from the electrolytes of the prior art.

In the past it has been the custom to maintain the proper ratios of copper and zinc in the electrolyte during the plating operation by using anodes made from copper and zinc in the desired ratios. As the electrolysis proceeds the copper and zinc content of the bath is maintained by the solution of the anode. In the experiments described above the required amounts of nickel and manganese have been added to the electrolyte in the form of soluble salts. Alternatively, the required amounts of these metals can be incorporated with the copper-zinc alloys used as anodes. In this manner, the required amounts of nickel and manganese will be maintained in the electrolyte as the anode dissolves during the electrolysis and the deposition of the brass.

What is claimed is:

1. In the process of electrodepositing brass from an an aqueous alkaline cyanide electrolyte containing a water-soluble manganous compound in an amount sufficient to provide 0.00005 – 0.1 g/l of manganese and 0.001 – 10 g/l of a water-soluble chelating or sequestering agent, the improvement which comprises incorporating in said electrolyte a water-soluble nickel compound in an amount sufficient to provide 0.0001 – 0.1 g/l of nickel.

2. An aqueous alkaline cyanide electrolyte for brass plating containing a water-soluble manganous compound in an amount sufficient to provide 0.00005 – 0.1 g/l of manganese and an amount of water-soluble nickel compound to provide 0.00001 – 0.1 g/l of nickel.

3. An aqueous alkaline cyanide electrolyte for brass plating according to claim 2 containing in addition 0.001 – 10 g/l of a water-soluble chelating or sequestering agent.

* * * * *